United States Patent [19]

Stollberg

[11] 4,304,351

[45] Dec. 8, 1981

[54] CONTAINER WITH COVER LOCK

[75] Inventor: Ray H. Stollberg, Gilroy, Calif.

[73] Assignee: Crown Zellerbach Corporation, San Francisco, Calif.

[21] Appl. No.: 165,515

[22] Filed: Jul. 3, 1980

[51] Int. Cl.[3] ..... B65D 5/34; B65D 55/00; B65D 5/66

[52] U.S. Cl. ..... 229/23 R; 229/35; 229/45 R; 229/44 R

[58] Field of Search ..... 229/23 R, 23 AB, 43, 229/44 R, 44 CB, 33, 45, 34 R, 35, DIG. 11

[56] References Cited

U.S. PATENT DOCUMENTS

| | | | |
|---|---|---|---|
| 2,203,127 | 6/1940 | Borah | 229/23 R |
| 2,511,523 | 6/1950 | Abrams | 229/34 R |
| 2,573,706 | 11/1951 | Grant | 229/23 R |
| 2,619,276 | 11/1952 | Gibbons | 229/33 |
| 3,713,579 | 1/1973 | Chaffers | 229/23 R |
| 3,973,723 | 8/1976 | Owens | 229/33 |

FOREIGN PATENT DOCUMENTS

| | | | |
|---|---|---|---|
| 1394973 | 3/1965 | France | 229/23 R |

*Primary Examiner*—Herbert F. Ross
*Attorney, Agent, or Firm*—Thomas R. Lampe

[57] ABSTRACT

A container comprising a box body defining an interior and having a ledge extending inwardly over the interior. A cover is selectively positionable over the interior and the ledge and a locking flap secured to the cover is adapted for positioning in an aperture formed between the ledge and a box body side wall to lock the cover in position over the interior and ledge. Latch means is provided for selectively retaining the locking flap within the aperture.

3 Claims, 8 Drawing Figures

CONTAINER WITH COVER LOCK

BACKGROUND AND OBJECTS OF THE INVENTION

The packing and shipping of produce such as grapes, tomatoes, cherries, etc. calls for the usage of specialized boxes of sturdy construction that are readily assembled and stacked. In addition, it is desirable to incorporate latch means on containers of this type to maintain the integrity of the box, especially during shipping.

A wide variety of containers have been devised for this purpose including those containers disclosed in U.S. Pat. No. 3,713,579, issued Jan. 30, 1973 to J. W. Chaffers, and applicant's copending application U.S. Ser. No. 068,781 filed Aug. 22, 1979 now U.S. Pat. No. 4,245,773, issued Jan. 20, 1981.

When packing produce and other similar materials it is a fairly common practice to "bulge pack", that is, over pack the container somewhat to compensate for settling of the contents occurring during transit. Bulge packing presents its own problems in that forces are exerted on the container which can deform the container sides and cause the container cover to become opened inadvertently. These problems become even more pronounced when the container is subjected to high humidity conditions as is often the case with grapes for example.

It is therefore an object of the present invention to provide a container that incorporates an improved positive locking structure which not only positively secures the cover in locked condition but also adds stability to the side walls of the container so that they can resist forces imparted thereto by the contents of the container during packing and shipping.

SUMMARY OF THE INVENTION

According to the present invention, a container is provided comprising a box body including side walls, and bottom wall defining an interior with the side walls, and a ledge connected to the side walls and extending inwardly over the interior, the ledge and connected side walls defining apertures therebetween. A cover is provided for the box body and is selectively positionable over the interior and the ledge with locking flaps secured to the cover adapted for positioning in the aperture when the cover is so positioned. Latch means is provided for selectively retaining the locking flap within the aperture so that the cover will be positively locked against upward movement. At the same time, any bulging of the side walls will be resisted by the locking flaps bearing against the ledge.

Other objects and characteristics of the invention will be apparent from the following more detailed description and accompanying drawings in which:

and

Figure 7:
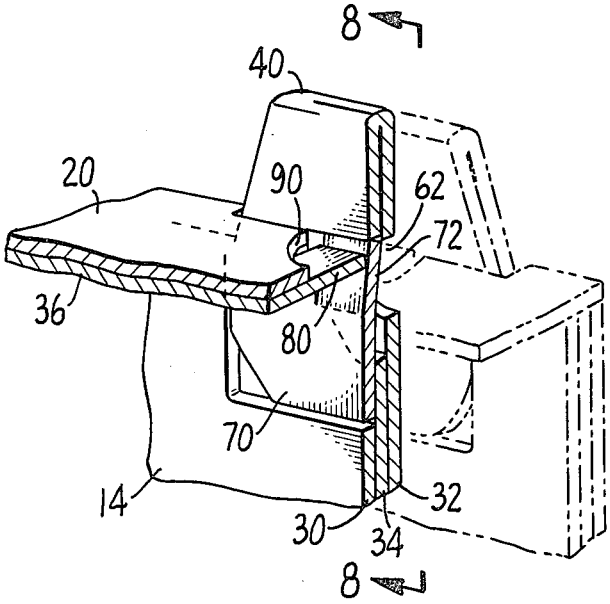
FIG. 7 is a view similar to that of FIG. 5 but showing the locking flap in the position assumed when the cover is closed.
Figure 8:
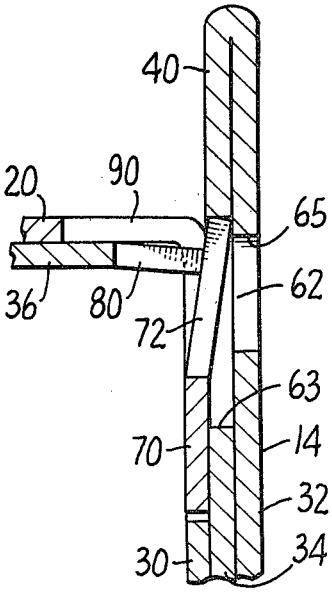

FIG. 8 is a sectional view taken along line 8—8 in FIG. 7.

DETAILED DESCRIPTION

Figure 1:
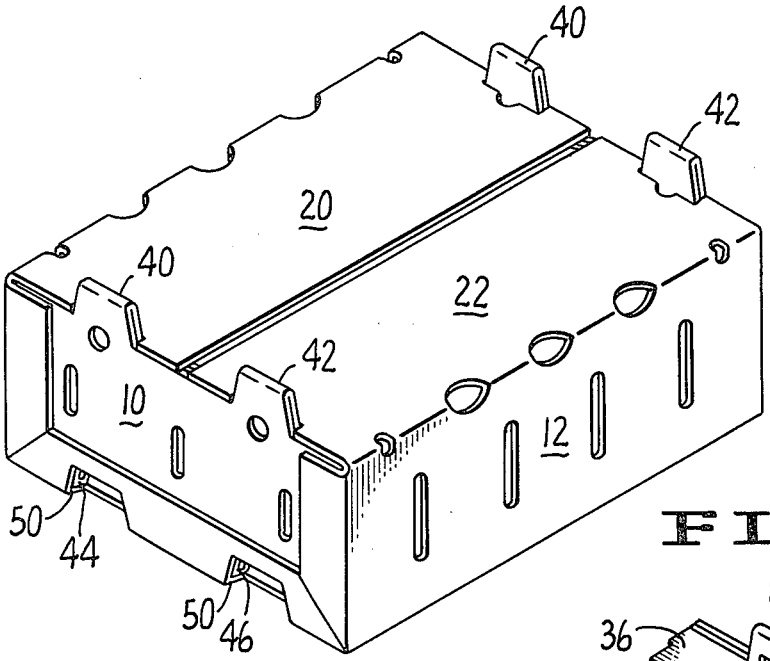
FIG. 1 is a perspective view of a closed container constructed in accordance with the teachings of the present invention.
Figure 2:
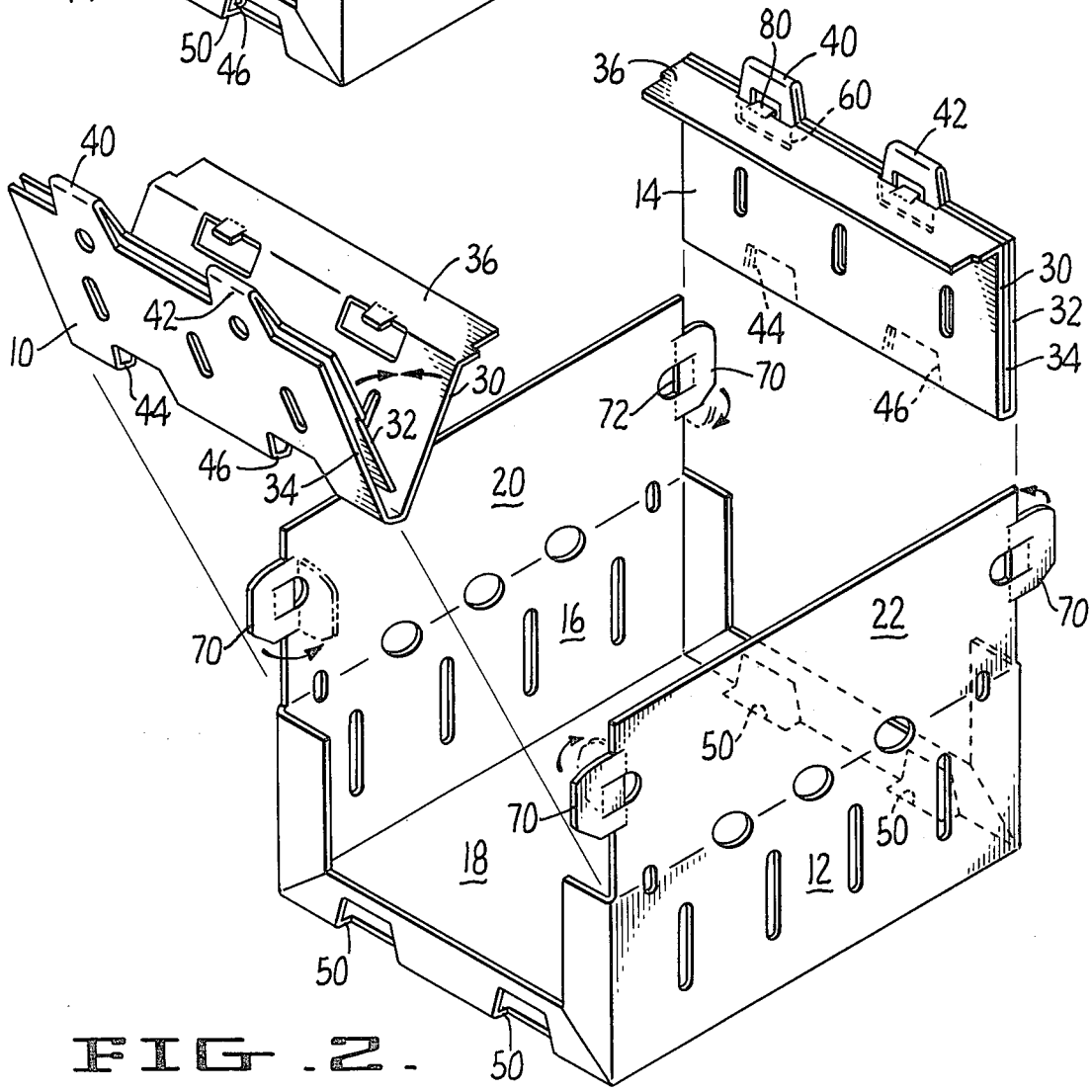
FIG. 2 is an exploded isometric view of the container, showing details of one partially formed end panel and one fully formed end panel.
Figure 3:
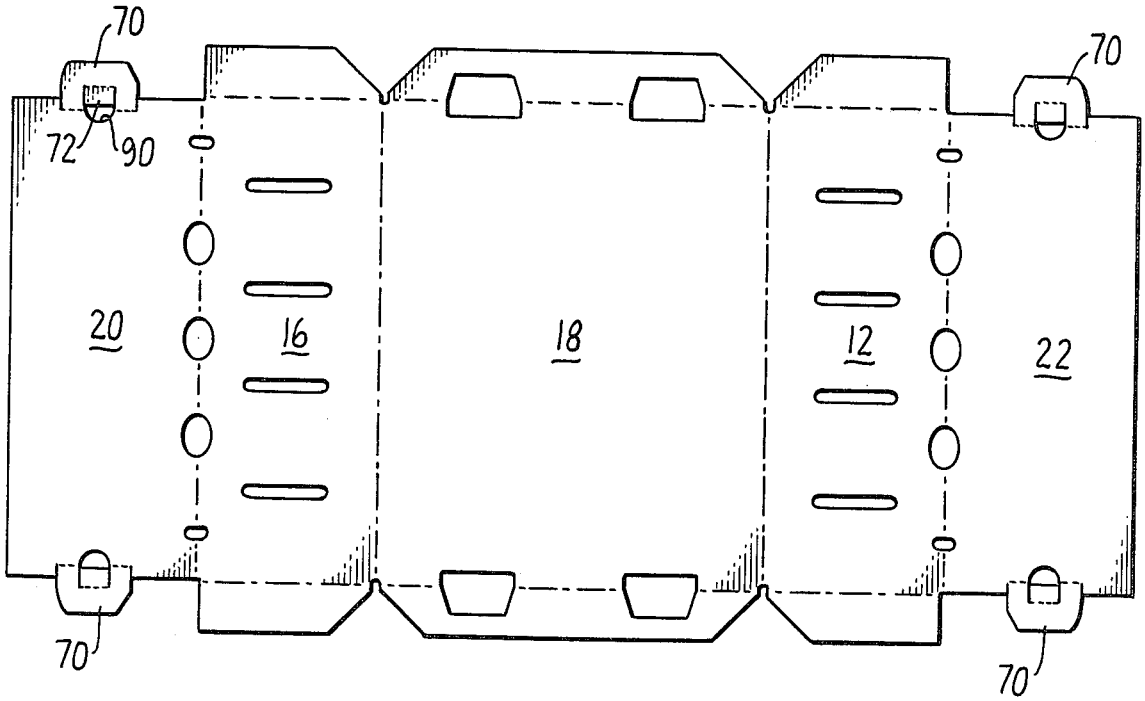
FIGS. 3 and 4 are plan views of blanks utilized in the construction of the container.

Referring now to FIGS. 1 and 2, the container constructed according the teachings of the present invention includes a box body consisting of four side walls 10, 12, 14, and 16 and bottom wall 18. Cover portions 20 and 22 are hingedly secured to side walls 16 and 12, respectively, to be selectively positioned over the box body interior to close the same as illustrated in FIG. 1.

Figure 4:
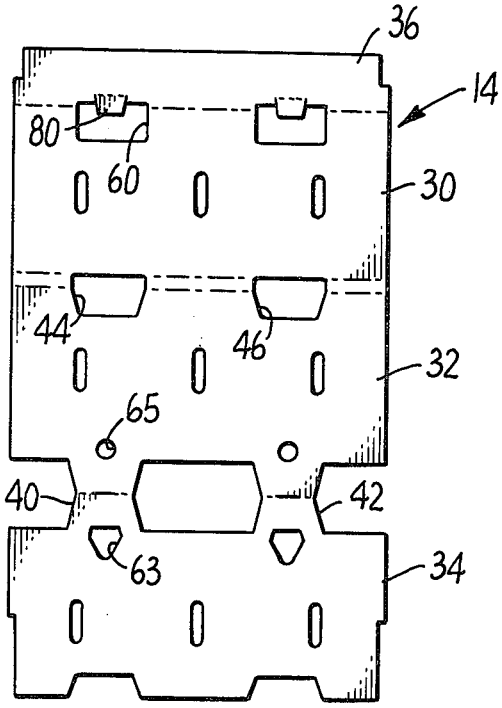

Side walls 10 and 14 are formed from a blank having the configuration illustrated in FIG. 4 wherein the blank used to construct side wall 14 is specifically illustrated. The blank includes three side wall sections 30, 32 and 34 secured together along hinge lines so that the sections may be folded into face-to-face engagement as shown in FIG. 2 to form an essentially 3-ply side wall. A ledge 36 is hingedly secured to section 30 and is adapted to be folded inwardly over the box interior when the container is assembled as shown in FIG. 2. It should also be the noted that the FIG. 4 blank is so configured as to result in the formation of stacking cleats 40 and 42 when side wall sections 32 and 34 are folded into face-to-face engagement. Apertures 44 and 46 formed in section 32 will accommodate stacking cleats of a container of similar construction when stacked.

Any suitable expedient may be used to assemble side walls 10 and 14 to the remainder of the container. In the arrangement illustrated, the container is held together by flaps extending along the edges of side walls 12 and 16 and bottom wall 18 adhesively attached or otherwise secured to side walls 10 and 14. It will also be appreciated that the side wall sections of side walls 10 and 14 are preferably secured together in 3-ply relationship by glue or other suitable expedient. When the side walls 10 and 14 are secured in position with the rest of the container the cleat accommodating apertures thereof such as apertures 44 and 46 will be in registry with other apertures 50 formed in container bottom 18 and the securing flaps depending therefrom.

Figure 5:
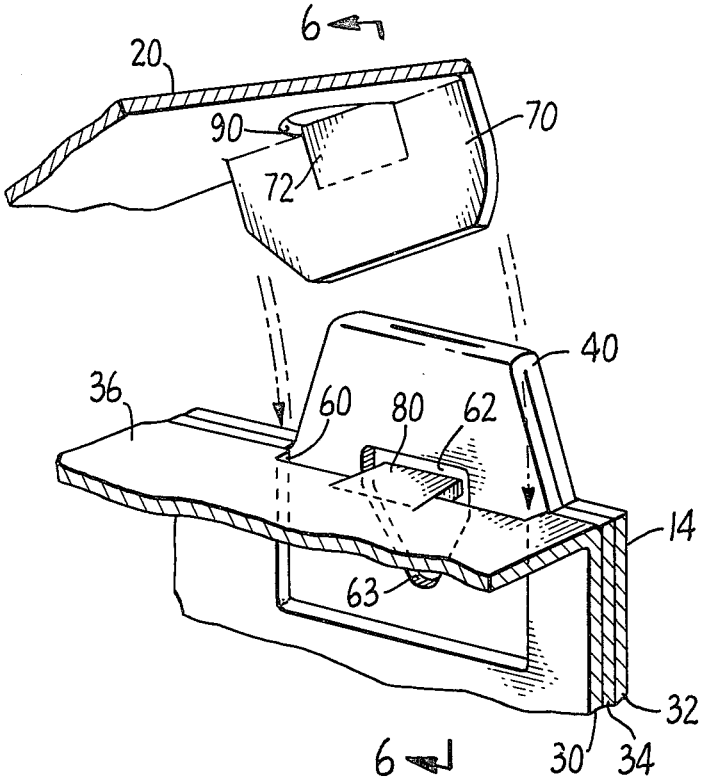
FIG. 5 is an enlarged detail view showing a cover locking flap just prior to being seated in an aperture defined by the container ledge and associated side wall.
Figure 6:
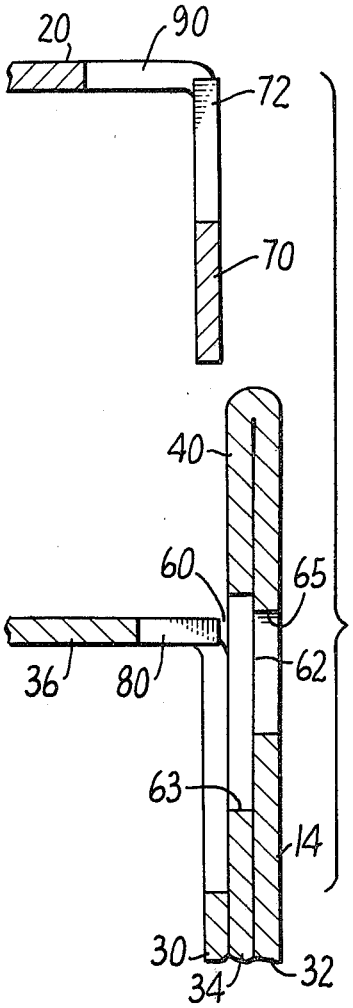
FIG. 6 is a sectional view taken along line 6—6 in FIG. 5.

Referring now to FIGS. 2, 5 and 6, it will be noted that the ledges and associated side walls define therebetween when the box body is assembled horizontally disposed apertures which are in communication with openings formed in the side walls 10 and 14 in the vicinity of the stacking cleats. In FIGS. 5 and 6 the aperture defined between the ledge 36 and side wall 14 in the vicinity of stacking cleat 40 is identified by reference numeral 60. With specific reference to FIG. 6 it will be noted that a recess in the form of opening 62 in side wall 14 is comprised of two throughbores 63 and 65 formed in side wall sections 32 and 34 disposed in alignment. Recess 62 is in communication with aperture 60.

The apertures defined by the ledges and associated side walls are adapted to accommodate locking flaps 70 connected to cover portions 20 and 22. In FIGS. 5 and 7 one such locking flap 70 is illustrated in the position assumed thereby just prior to being introduced into aperture 60. FIGS. 7 and 8 illustrate the relative positions assumed by these components when cover portion 20 has been positioned over ledge 60 and the interior defined by the box body.

According the present invention latch means is provided for selectively retaining the locking flap within the aperture defined between the ledge and associated side wall. In particular, each locking flap 70 has a primary locking tab 72 formed therein which is adapted to be positioned in recess 62 after the cover portion has been positioned on the container ledge. This is best illustrated in FIGS. 7 and 8 wherein primary locking tab 72 is shown in recess 62 with the upper portion of the primary locking tab in butting engagement with side wall section 34. Primary locking tab 72 is biased into this position by means of an auxiliary locking tab 80 projecting into aperture 60 from ledge 36. Such an arrangement provides a positive locking force maintaining the cover portions of the container in locked position. In addition, outward bulging of side walls 10 and 14 will be resisted due to the fact that locking flaps 70 will prevent outward displacement of the ledges connected to said side walls. It should be noted that recess 62 and hence primary locking tab 72 are disposed below the level of the cover portion when in locking position thus preventing damage to the primary locking tab and inadvertent delatching thereof through the application of outside forces encountered during shipping. When it is desired to open the cover, however, this may be readily accomplished merely through the insertion of a finger through the opening defining recess 62 to push the primary locking tab inwardly and simultaneously pushing auxilliary locking tab 80 downwardly by inserting a finger through a finger hole 90 formed in the cover portion.

If desired, the throughbore 65 in side wall section 32 may be eliminated so that recess 62 is defined only by throughbore 63 in side wall section 34. If such an arrangement is employed, pilfering from the container is discouraged since removal of the cover can not be accomplished without damage to the container structure occurring. Damage occurring when the container is opened upon reaching its final destination is not harmful since fruit and vegetable shipping containers are not normally reused.

I claim:

1. A container comprising:

a box body including side walls, a bottom wall defining an interior with said side walls and a ledge connected to at least one of said side walls and extending inwardly over said interior, said ledge and connected side wall defining an aperture therebetween in communication with a recess formed in the connected side wall:

a cover for said box body selectively positionable over said interior and said ledge;

a locking flap secured to said cover adapted for positioning in said aperture when said cover is positioned over said interior and said ledge;

latch means comprising a primary locking tab hingedly connected to said locking flap and movable to project outwardly therefrom to enter said recess and bear against the connected side wall to lock the cover on the box body by selectively retaining said locking flap within said aperture; and an auxiliary locking tab hingedly connected to said ledge and projecting into said aperture, said auxiliary locking tab adapted to bear outwardly against said primary locking tab when said primary locking tab is in said recess to maintain the locking tab projecting outwardly from said locking flap and in said recess.

2. The container of claim 1 wherein said recess is an opening formed in said side wall and wherein the auxiliary locking tab is in alignment with said opening when bearing against said primary backing tab.

3. The container of claim 1 wherein a hole is formed in said cover, said hole being disposed in registry with said auxiliary locking tab to permit manual manipulation thereof when said cover is positioned over said box extension.

* * * * *